US010858146B2

(12) United States Patent
Aryanpanah

(10) Patent No.: US 10,858,146 B2
(45) **Date of Patent: *Dec. 8, 2020**

(54) CHILDPROOF BOX

(71) Applicant: David Aryanpanah, Beverly Hills, CA (US)

(72) Inventor: David Aryanpanah, Beverly Hills, CA (US)

( * ) Notice: Subject to any disclaimer, the term of this patent is extended or adjusted under 35 U.S.C. 154(b) by 215 days.

This patent is subject to a terminal disclaimer.

(21) Appl. No.: 15/919,029

(22) Filed: Mar. 12, 2018

(65) Prior Publication Data

US 2019/0071213 A1 Mar. 7, 2019

Related U.S. Application Data

(63) Continuation of application No. 15/694,693, filed on Sep. 1, 2017, now Pat. No. 9,938,042.

(51) Int. Cl.

| | |
|---|---|
| ***B65D 6/00*** | (2006.01) |
| ***B65D 6/06*** | (2006.01) |
| ***A61J 1/03*** | (2006.01) |
| ***B65D 50/04*** | (2006.01) |

(52) U.S. Cl.

CPC ..... *B65D 11/20* (2013.01); *A61J 1/03* (2013.01); *B65D 11/12* (2013.01); *B65D 50/04* (2013.01)

(58) Field of Classification Search

CPC ..... B65D 11/12; B65D 11/10; B65D 11/00; B65D 5/38; A61J 1/00; A61J 1/03

USPC ..... 206/1.5, 528, 534, 534.1, 538, 468

See application file for complete search history.

(56) References Cited

U.S. PATENT DOCUMENTS

| | | | |
|---|---|---|---|
| 3,888,350 | A | 6/1975 | Horvath |
| 3,907,103 | A | 9/1975 | Shaw |
| 3,942,630 | A | 3/1976 | Phillips |
| 4,113,098 | A | 9/1978 | Howard |
| 4,126,224 | A | 11/1978 | Laauwe |
| 4,561,544 | A | 12/1985 | Reeve |
| 4,730,731 | A | 3/1988 | Allison |
| 4,741,433 | A | 5/1988 | Irvine |
| 1,805,790 | A | 2/1989 | Leonetti |
| 4,844,284 | A | 7/1989 | Drozd |
| 4,991,730 | A | 2/1991 | Pehr |

(Continued)

FOREIGN PATENT DOCUMENTS

| | | |
|---|---|---|
| EP | 2799364 | 11/2014 |

*Primary Examiner* — Steven A. Reynolds
*Assistant Examiner* — Javier A Pagan
(74) *Attorney, Agent, or Firm* — Jafari Law Group, Inc.

(57) ABSTRACT

The invention involves a childproof box that suitable for medicinal items such as tablets, medication or other consumables that may be desirably restricted from children. The childproof mechanism that restricts access to the contents of the box may employ a base shell that slides in and out of a cover shell, which respectively conceals and exposes a storage cavity. Both shells have corresponding tracks and corresponding protrusions configured to engage with each other in a manner so that the base shell may only be accessed (or slid open) when a user presses and pushes on a top surface of the cover shell. The structural elements of each of the shells are such that a user may operate the childproof box with a single hand. In exemplary embodiments, the childproof box comprises of flat surfaces that form a generally rectangular box, which is easy to carry, manipulate and store.

20 Claims, 7 Drawing Sheets

(56) References Cited

U.S. PATENT DOCUMENTS

| | | | | |
|---|---|---|---|---|
| 5,080,222 | A * | 1/1992 | McNary | B65D 50/045 206/1.5 |
| 5,082,137 | A | 1/1992 | Weinstein | |
| 5,460,287 | A | 10/1995 | Cargile | |
| 5,718,347 | A | 2/1998 | Walker | |
| D446,718 | S | 8/2001 | Anderson | |
| 7,708,142 | B2 | 5/2010 | Ehrlund | |
| 7,757,843 | B2 * | 7/2010 | Katsis | A24F 27/00 206/1.5 |
| 9,938,042 | B1 * | 4/2018 | Aryanpanah | B65D 50/04 |
| 2004/0055903 | A1 * | 3/2004 | Nishimura | B65D 83/08 206/1.5 |
| 2007/0164032 | A1 | 7/2007 | Cronin | |
| 2010/0038278 | A1 | 2/2010 | Gattefosse | |
| 2010/0133140 | A1 | 6/2010 | Bailey | |
| 2011/0000931 | A1 | 1/2011 | Gelardi | |
| 2017/0137167 | A1 | 5/2017 | Warner | |

* cited by examiner

FIG. 4(e)
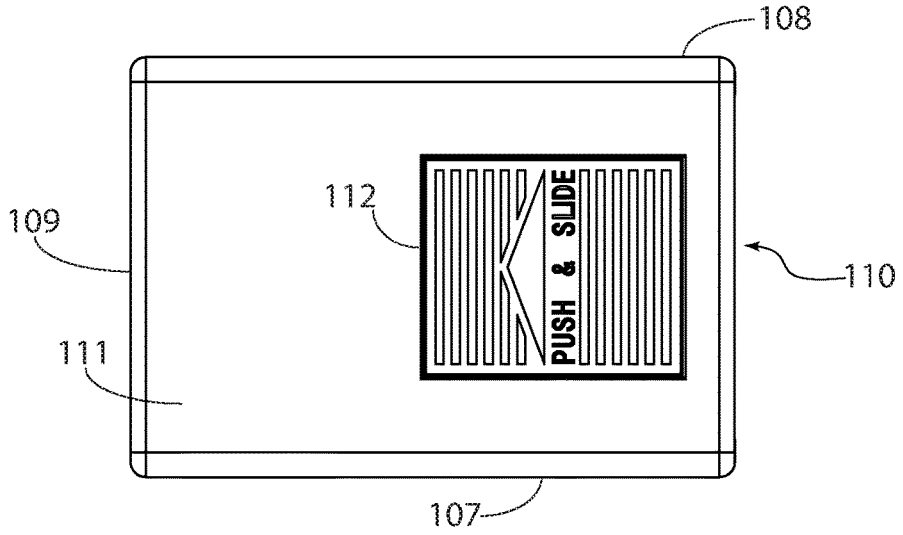
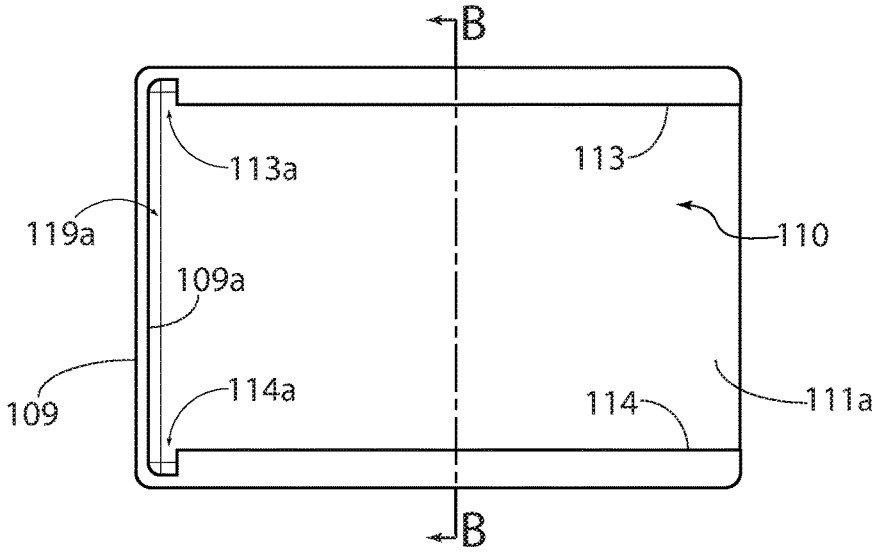
FIG. 4(f)
FIG. 4(g)
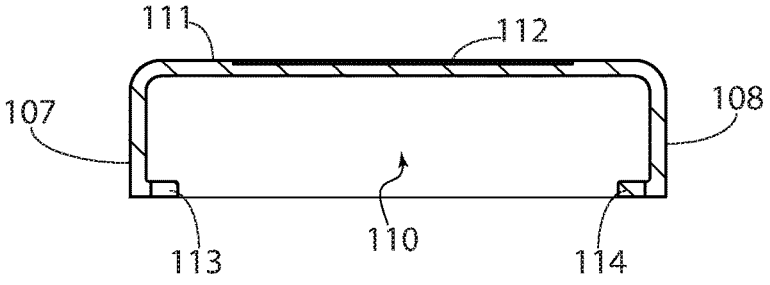

CHILDPROOF BOX

PRIORITY NOTICE

The present application is a continuation of U.S. patent application Ser. No. 15/694,693, filed on Sep. 1, 2017, the disclosure of which is incorporated herein by reference in its entirety.

TECHNICAL FIELD OF THE INVENTION

The present invention relates generally to a childproof receptacle or container, and more specifically, to a childproof box for storing items such as medicinal consumables in a manner that restricts access to children, but that is easy to operate by the elderly.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Childproof receptacles or containers, such as childproof medicine bottles and childproof boxes have been around for some time. In fact, the prior art is busy with different teachings for a wide variety of these so-called safety containers. However, known devices have several shortcomings which have not been properly addressed.

For example, several teachings focus on devices that require heightened dexterity—typically requiring the use of multiple hands—in order to operate the locking means of the container. Other devices involve structural elements that facilitate the locking means of these containers, but which restrict the usable space within the receptacle. Other designs involve odd shapes that are not ideal for easily carrying around the receptacles, which often carry daily medicine and are thus needed on a regular basis; moreover, odd or uneven shaped containers make their storage by manufacturers or distributers much more difficult. Yet other designs have complex features that may provide characteristics such as air tight seals, but which necessarily make the device more difficult to operate by elderly individuals—typically due to tougher material requirements.

One such device is taught by U.S. Pat. No. 3,888,350 to Horvath. Horvath describes a snap-lock and squeeze-open slide top container that has a small centered catch depending from the interior face of a cover. To operate this device, a user must squeeze the sides of the container with one hand and pull a drawer bottom container with the other hand. Although requiring multiple hands to operate may (although not necessarily) prevent children from accessing its contents, this method of operation is often difficult for the elderly to operate.

Another such device is taught by U.S. Pat. No. 4,113,098 to Howard. Howard describes a dispensing and storage container for various articles, particularly pills, wherein the stored articles are readily available when needed; the storage container includes a safety mechanism to prevent accidental access to the pills. To prevent accidental opening of the container, one of the walls of the receptacle is provided with a lock recess in which a locking lug is removably received. In order to unlock the cover from the receptacle, the cover is provided with a pair of oppositely arranged, flexible tab members which, when pressed inwardly, cause the cover to bow and thus disengage the locking lug from the locking recess, whereby the cover can be moved rearwardly of the receptacle and thus expose the storage compartment. Again, this requires a user to simultaneously press on the sides of the container prior to being able to open a receptacle with a second hand.

Similarly, U.S. Patents to Laauwe (U.S. Pat. No. 4,126,224), Reeve (U.S. Pat. No. 4,561,544), Katsis et al. (U.S. Pat. No. 7,757,843), and Drozd (U.S. Pat. No. 4,844,284) all teach distinct types of childproof or safety containers that include locking mechanisms requiring use of multiple hands.

Katsis, for example, teaches a childproof packaging for a product such as matches or pharmaceutical tablets that includes a sleeve and a container for the product within the sleeve. A user must use both hands simultaneously, with a respective hand operating a respective pair of latches, to hold the latches in an unlatched condition and also simultaneously to apply pressure to the container to slide it outwardly relatively to the sleeve. According to Katsis, such a two-handed, five-finger-operation to open the package requires a dexterity that is supposedly easy for adults but very difficult for children. However, such complex devices have been known to cause undesirable difficulties to elderly users.

Drozd describes a child-resistant package that includes a tray with a compartment therein for receiving articles to be packaged, and a cover member slidably received on the tray and movable relative to the tray between opened and closed positions. To operate this device, the index fingers of both hands must be used to press down on a bottom wall of a tray, which releases a locking mechanism that includes an internal abutment means or rib that juts out of one of the interior walls of the receptacle. Not only does this mechanism require an internal structure that interferes with the usable space for storing items, but the use of both hands unnecessarily complicates operation of the package. Thus, it would be desirable that safety containers such as childproof containers be easy to operate by all adults, including the elderly, which often have trouble operating the more complex two-handed locking mechanisms.

Other known devices have somewhat addressed this problem by implementing locking mechanisms that do not require two hands. For example, U.S. Pat. No. 5,080,222 to McNary discloses a safety box having a cover slidably receiving a tray. Vertical and horizontal rails are provided on the interior of the sidewalls of the cover which cooperate with laterally extending lugs on the sidewalls of the tray to preclude movement of the tray relative to the cover unless the cover is bowed by utilizing a vertical force to it to flare-the vertical rails away from the lugs. In order to enable operation of this device, both the cover portion and the base or drawer portion must be flexible enough to allow bowing. One problem with this approach is that by requiring both a top and bottom surface to be pressed inward (into the containment cavity) in order to release the drawer, the space inside the containment cavity is limited and thus not efficiently utilized. Another problem with this design is that although perpendicular rails are provided to limit complete disassociation or removal, the container may nonetheless be completely disengaged from each other, which poses a risk that a child may ply the container apart.

Thus, it would be desirable that safety containers such as childproof containers implement mechanisms that do not substantially interfere with efficient use of the storage space otherwise available, and that such containers implement features that prevent disassembly.

Yet other examples are more complex and require tougher construction, which often result in devices that are more strenuous to operate and utilize materials that are not cost effective. U.S. Patent Publication 2004/0055903 A1 to Nishimura is one such device. Nishimura describes a slide open container that includes a resilient cover providing an air-tight seal. A big problem with these types of devices is how hard they are to operate for adults with less or diminished strength, such as is common of elderly patients. Another problem is that the cover must be shaped accordingly to enable a pressing of the otherwise harder plastic that is implemented in order to achieve the air-tight seal—for example, Nishimura describes a convex exterior surface that may be flattened by a user in order to disengage a locking means. Another setback of this structure is that such receptacles are inherently more difficult to store (for the user as well as distributors that may want to store in a manner efficient for inventory purposes), because for example, they are not easily stackable. Thus, it would be desirable that safety containers such as childproof containers implement materials and designs that are not strenuous to operate. Moreover, it would be desirable that such childproof containers implement easily manageable shapes that do not substantially interfere with efficient storage of the receptacle so that these items can be stored efficiently by a distributor (for example a pharmacy) as well as in a storage cabinet or a pocket of an individual.

Therefore, there exists a previously unappreciated need for a new and improved childproof box that is easy to operate by all adults, including the elderly; that implements mechanisms that do not substantially interfere with efficient use of the storage space within the container; and that are shaped for efficient storage and handling of the containers.

It is to these ends that the present invention has been developed.

SUMMARY OF THE INVENTION

To minimize the limitations in the prior art, and to minimize other limitations that will be apparent upon reading and understanding the present specification, the present invention describes a childproof box for storing items in a manner that restricts access to children, but that is easy to operate by the elderly.

Generally, the invention involves a childproof box that may be suitable for items such as matches, pills, pharmaceutical tablets, prescription medication, non-prescription medication, supplements, edibles or consumables and other items that may be desirably restricted from children. In exemplary embodiments, the childproof mechanism that restricts access to the contents of the box employs a rigid base shell that registers with, and slides in and out of, a flexible cover shell to respectively conceal and expose a storage cavity of the rigid base shell. Both shells have registering tracks and registering protrusions configured to engage with each other in a manner so that the base shell may only be accessed (or slid open) when a user presses and pushes on a top surface of the cover shell. The structural elements of each of the shells are such that a user may operate the childproof box with a single hand. Moreover, structural elements include locking ridges for preventing the childproof box from being easily opened, as well as retention ridges that prevent the base shell of the childproof box from being taken apart or disengaged entirely from the cover shell. In exemplary embodiments, the childproof box comprises flat surfaces that form a generally rectangular box, which is easy to carry, manipulate, and store.

A childproof box in accordance with one exemplary embodiment of the present invention, comprises: a flexible cover shell; and a rigid base shell that slidably registers inside an open cavity of the flexible cover shell, wherein the flexible cover shell comprises: a top surface, a front opening, a back wall and two cover side walls forming the open cavity in-between, the two cover side walls including: tracks running along a bottom edge of an interior side surface of each cover side wall, the tracks extending from the front opening and terminating at an aperture formed between the back wall and each of the tracks; a pair of locking ridges protruding from the interior side surface of each cover side wall that engage with a pair of corresponding locking ridges protruding from an exterior side surface of base side walls of the rigid base shell; and a pair of retention ridges protruding from the interior side surface that align with a pair of corresponding retention ridges protruding from the exterior side surface of the rigid base shell, wherein: pressing and pushing on the top surface of the flexible cover shell disengages the pair of locking ridges from the pair of corresponding locking ridges to allow the rigid base shell to slide open without misaligning the pair of retention ridges of the flexible cover shell from the pair of corresponding retention ridges of the rigid base shell, retaining the rigid base partially within the open cavity of the flexible cover.

A childproof box in accordance with another exemplary embodiment of the present invention, comprises: a flexible cover shell; and a rigid base shell that slidably registers inside an open cavity of the flexible cover shell, wherein the rigid base shell comprises: a bottom surface, a front wall, a base back wall and two base side walls forming a closed cavity in-between, each of the two base side walls including corresponding tracks configured to register with tracks of the flexible cover shell, the corresponding tracks extending along a bottom edge of each side wall from the front wall to the base back wall of the rigid base shell; a pair of corresponding locking ridges protruding from an exterior side surface of each base side wall that engage with a pair of locking ridges protruding from an interior side surface of cover side walls of the flexible cover shell; and a pair of corresponding retention ridges protruding from the exterior side surface that align with a pair of retention ridges protruding from the interior side surface of the flexible cover shell, wherein: pressing and pushing on a top surface of the flexible cover shell disengages the pair of locking ridges from the pair of corresponding locking ridges to allow the rigid base shell to slide open without misaligning the pair of retention ridges of the flexible cover shell from the pair of corresponding retention ridges of the rigid base shell, retaining the rigid base partially within the open cavity of the flexible cover.

A childproof box in accordance with yet another exemplary embodiment of the present invention, comprises: a flexible cover shell; and a rigid base shell that slidably registers inside an open cavity of the flexible cover shell, wherein the flexible cover shell comprises: an exterior flat surface including a serrated area, an interior flat top surface excluding any protrusions, a front opening, a back wall and two cover side walls forming the open cavity in-between, the two cover side walls including: tracks running along a bottom edge of an interior side surface of each cover side wall, the tracks extending from the front opening and terminating at an aperture formed between the back wall and each of the tracks; a pair of locking ridges protruding from the interior side surface of each cover side wall that engage with a pair of corresponding locking ridges protruding from an exterior side surface of base side walls of the rigid base shell; and a pair of retention ridges protruding from the interior side surface that align with a pair of corresponding retention ridges protruding from the exterior side surface of the rigid base shell; wherein the rigid base shell comprises a bottom surface, a front wall, a base back wall and two base side walls forming a closed cavity in-between, each of the two base side walls including corresponding tracks configured to register with the tracks of the flexible cover shell, the corresponding tracks extending along a bottom edge of each side wall from the front wall to the base back wall of the rigid base shell; and wherein pressing and pushing on the top surface of the flexible cover shell disengages the pair of locking ridges from the pair of corresponding locking ridges to allow the rigid base shell to slide open without misaligning the pair of retention ridges of the flexible cover shell from the pair of corresponding retention ridges of the rigid base shell, retaining the rigid base partially within the open cavity of the flexible cover.

It is an objective of the present invention to provide a childproof box that is easy to operate by all adults, including the elderly.

It is another objective of the present invention to provide a locking mechanism that does not require use of multiple hands in order to operate.

It is yet another objective of the present invention to provide a childproof box having mechanisms that do not substantially interfere with efficient use of the storage space available within a compartment of the box.

It is yet another objective of the present invention to provide a childproof box that is shaped for efficient storage and handling of the containers, by manufacturers, distributors, and users alike.

These advantages and features of the present invention are not meant as limiting objectives, but are described herein with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of the various embodiments of the invention. Furthermore, elements that are known to be common and well understood to those in the industry are not depicted in order to provide a clear view of the various embodiments of the invention. The drawings that accompany the detailed description can be briefly described as follows:

FIG. 4(*b*) illustrates a front view of a cover shell for a childproof box in accordance with an exemplary embodiment of the present invention.

FIG. 4(*c*) illustrates a back view of a cover shell for a childproof box in accordance with an exemplary embodiment of the present invention.

FIG. 4(*d*) illustrates a side view of a cover shell for a childproof box in accordance with an exemplary embodiment of the present invention.

FIG. 4(*e*) illustrates a top view of a cover shell for a childproof box in accordance with an exemplary embodiment of the present invention.

FIG. 4(*f*) illustrates a bottom view of a cover shell for a childproof box in accordance with an exemplary embodiment of the present invention.

FIG. 4(*g*) illustrates a cross-sectional view of a cover shell for a childproof box in accordance with an exemplary embodiment of the present invention.

FIG. 5(*b*) illustrates a side view of a base shell for a childproof box in accordance with an exemplary embodiment of the present invention.

FIG. 5(*c*) illustrates a front view of a base shell for a childproof box in accordance with an exemplary embodiment of the present invention.

FIG. 5(*d*) illustrates a top view of a base shell for a childproof box in accordance with an exemplary embodiment of the present invention.

FIG. 5(*e*) illustrates a close-up view of locking and retention protrusions for a base shell of a childproof box in accordance with an exemplary embodiment of the present invention.

FIG. 5(*f*) illustrates a cross-sectional view of a base shell for a childproof box in accordance with an exemplary embodiment of the present invention.

FIG. 6(*b*) illustrates a cross-sectional view of a childproof box in accordance with an exemplary embodiment of the present invention.

DETAILED DESCRIPTION OF THE INVENTION

Figure 1:
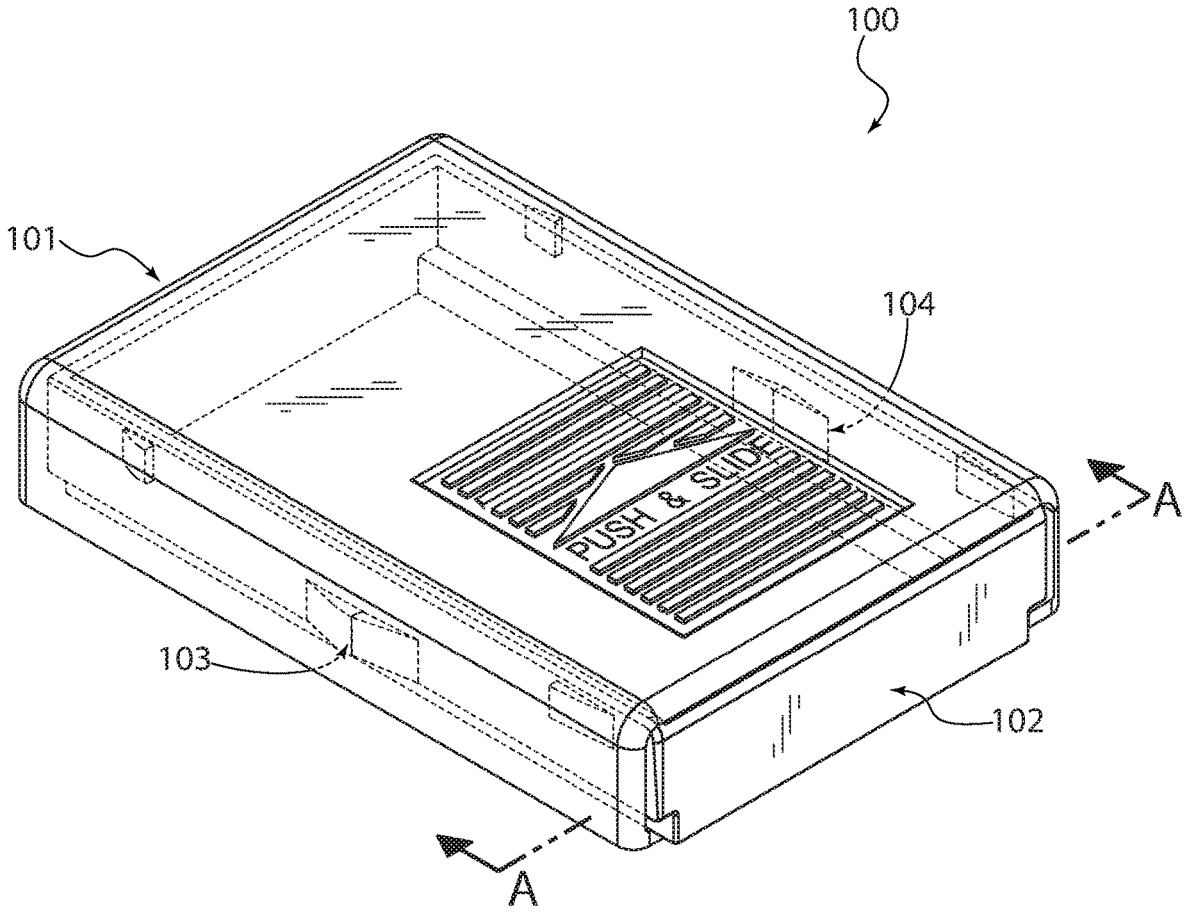
FIG. 1 illustrates a perspective view of a childproof box in accordance with an exemplary embodiment of the present invention, shown in a close position.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention. Wherever possible, the same reference numbers are used in the drawings and the following description to refer to the same or similar elements.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and or steps. Thus, such conditional language is not generally intended to imply that features, elements and or steps are in any way required for one or more embodiments, whether these features, elements and or steps are included or are to be performed in any particular embodiment.

The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present. The term "and or" means that "and" applies to some embodiments and "or" applies to some embodiments. Thus, A, B, and or C can be replaced with A, B, and C written in one sentence and A, B, or C written in another sentence. A, B, and or C means that some embodiments can include A and B, some embodiments can include A and C, some embodiments can include B and C, some embodiments can only include A, some embodiments can include only B, some embodiments can include only C, and some embodiments include A, B, and C. The term "and or" is used to avoid unnecessary redundancy.

While exemplary embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the invention or inventions disclosed herein. Accordingly, the following detailed description does not limit the disclosure. Instead, the proper scope of the disclosure is defined by the appended claims.

Turning now to the figures, FIG. 1 illustrates a perspective view of a childproof box in accordance with an exemplary embodiment of the present invention, shown in a close position. More specifically, FIG. 1 shows childproof box 100, which comprises flexible cover shell 101 and rigid base shell 102. Rigid base shell 102 slidably registers inside a cavity of flexible cover shell 101. Both shells include complementary elements that register together or engage to form locking components 103 and 104 and retention components 105 and 106 (see FIG. 2), which are located internally (when closed as in FIG. 1) protruding from side walls of each shell. Locking components 103 and 104 prevent rigid base shell 102 from being easily slid into an open position (unless operated to disengage the same). Retention components 105 and 106 prevent rigid base shell 102 from being completely removed or decoupled from flexible cover shell 101.

Flexible cover shell 101 is typically made of a plastic or copolymer implementing a density, strength, and hardness such that the cover shell is flexible. Moreover, certain structural elements may be implemented such as aperture 119*a* (see FIG. 4(*f*)) in order to improve a flexibility for the cover shell. Conversely, rigid base shell 102 is typically made of a plastic or copolymer implementing a density, strength, and hardness such that the base shell is rigid and does not bow or flex when pressed upon. This configuration of childproof box 100 aids in the safety aspect of the receptacle, because it is more difficult for small children to open by, for example, biting the box or plying it open. Moreover, this configuration makes operation of childproof box 100 easily manageable with a single hand so that elderly adults or adult users with diminished strength can operate childproof box 100 with ease.

In exemplary embodiments, each shell is rectangular as shown in the figures, although in other embodiments a square shape may be implemented without deviating from the scope of the present invention. A childproof box in accordance with the present invention may be constructed using one or several types of plastics or polymers. In exemplary embodiments however, plastic resins certified as USP Class VI may be utilized so that the receptacle is suitable as a medical device—this may be useful for implementation with prescription or non-prescription medications, other medicinal items and edibles or consumables that be desirably restricted from children.

Figure 2:
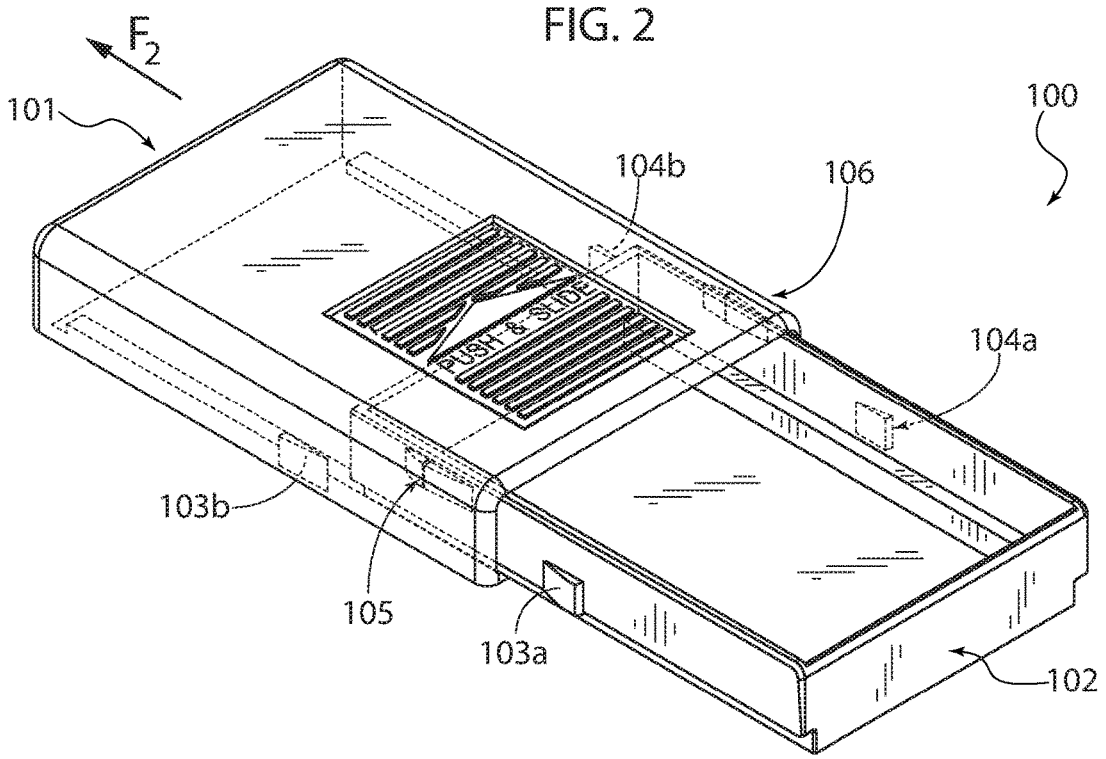
FIG. 2 illustrates a perspective view of a childproof box in accordance with an exemplary embodiment of the present invention, shown in an open position.

Turning now to the next figure, FIG. 2 illustrates a perspective view of childproof box 100, shown in an open position. More specifically, FIG. 2 depicts rigid base shell 102, which has been slid out of a cavity extending through opening 110 within flexible cover 101 to the open position—making any items or articles therein accessible to a user. From this view, retention components 105 and 106 may be better appreciated; although the individual retention ridges 105*a*, 105*b*, 106*a*, and 106*b* are also visible in FIG. 1, albeit disengaged. In the view of FIG. 2, wherein childproof box 100 is in the open position, retention ridges 105*a*, 105*b*, 106*a*, and 106*b* are in the engaged position (touching each other) to form retention components 105 and 106 to prevent rigid base shell 102 from being removed from the flexible cover shell 101.

Opening or accessing a storage cavity of rigid base shell 102 is typically achieved by pressing and pushing on a portion of top surface 111 of flexible cover shell 101 (for example pressing serrated section 112 (see FIG. 4(*a*)) in order to disengage a pair of locking ridges 103*a* and 104*a* of rigid base shell 102 from a pair of corresponding locking ridges 103*b* and 104*b* (respectively) of flexible cover shell 101 that (respectively) form locking components 103 and 104. Disengaging these locking components allows rigid base shell 102 to slide open upon the user simultaneously pushing on flexible cover shell 101.

Moreover, and as will be explained in more detail below with reference to FIG. 7, pressing down and pushing on top surface 111 of flexible cover 101 disengages each locking component 103 and 104 without misaligning the pair of retention ridges 105*b* and 106*b* of flexible cover shell 101 from the pair of corresponding retention ridges 105*a* and 106*a* of rigid base shell 102 (see for example FIG. 7), thereby retaining rigid base shell 102 partially within the cavity extending into flexible cover shell 101 from opening 110, as shown in FIG. 2. Since pressing down and pushing on top surface 111 of flexible cover shells 101 does not misalign retention ridges 105*b* and 106*b* from retention ridges 105*a* and 106*b*, these elements engage to form retention components 105 and 106 preventing rigid base shell 102 from being removed completely or disengaged from flexible cover shell 101.

Figure 3:
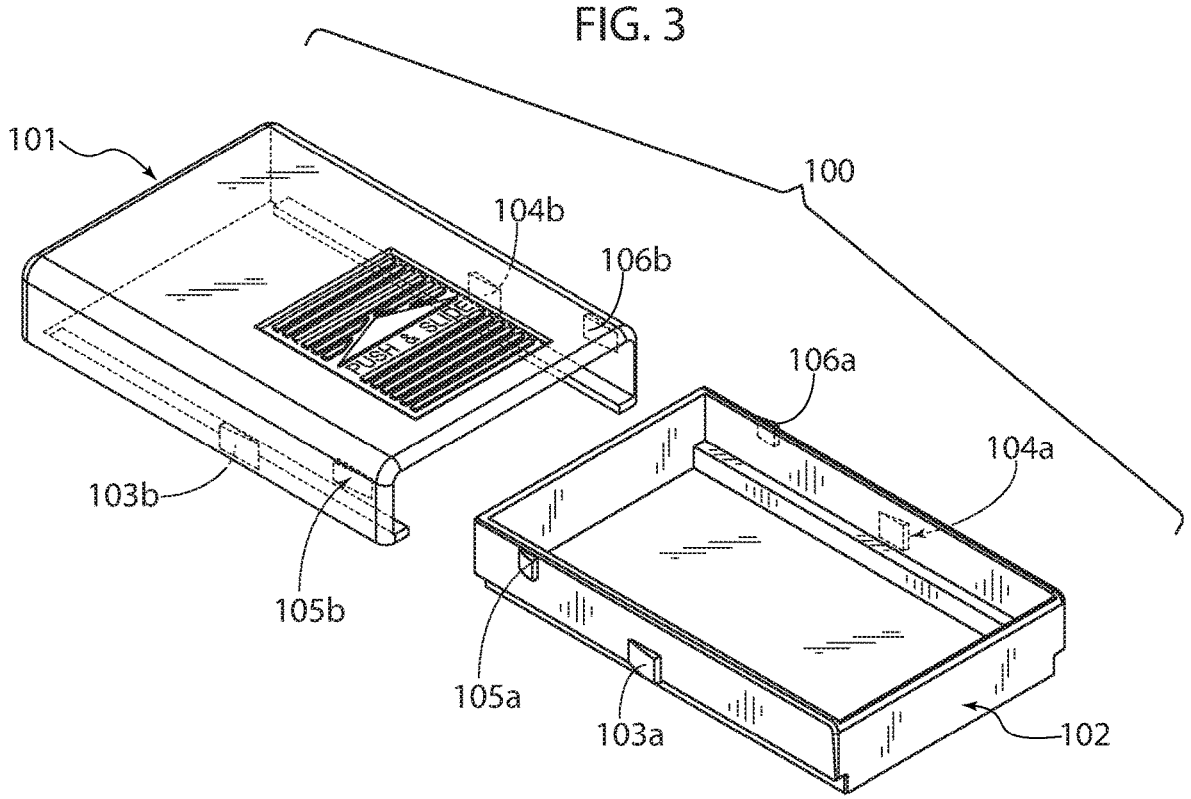
FIG. 3 illustrates a perspective exploded view of a childproof box in accordance with an exemplary embodiment of the present invention.
Figure 4A:
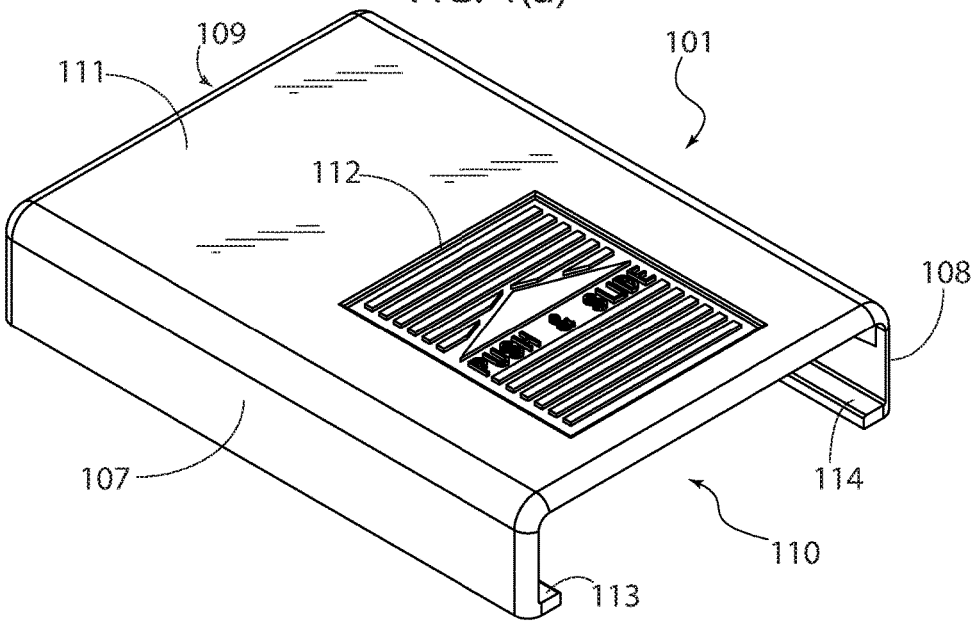
FIG. 4(*a*) illustrates a perspective view of a cover shell for a childproof box in accordance with an exemplary embodiment of the present invention.
Figure 4B:
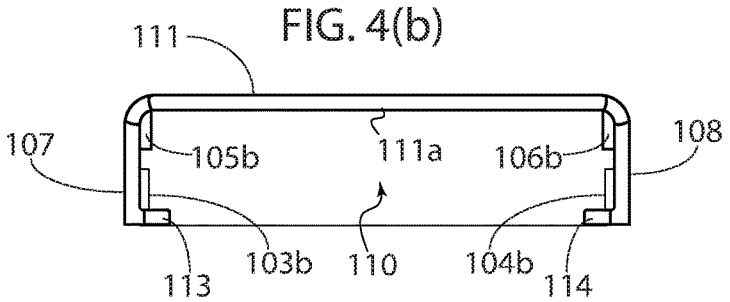
Figure 4C:
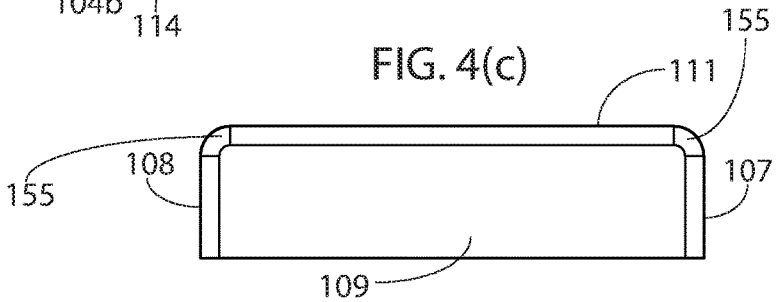
Figure 4D:
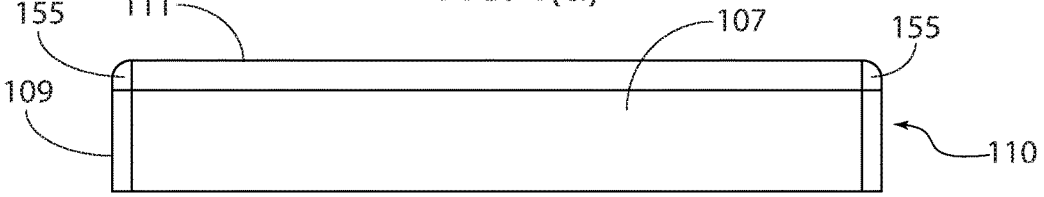
Figure 5A:
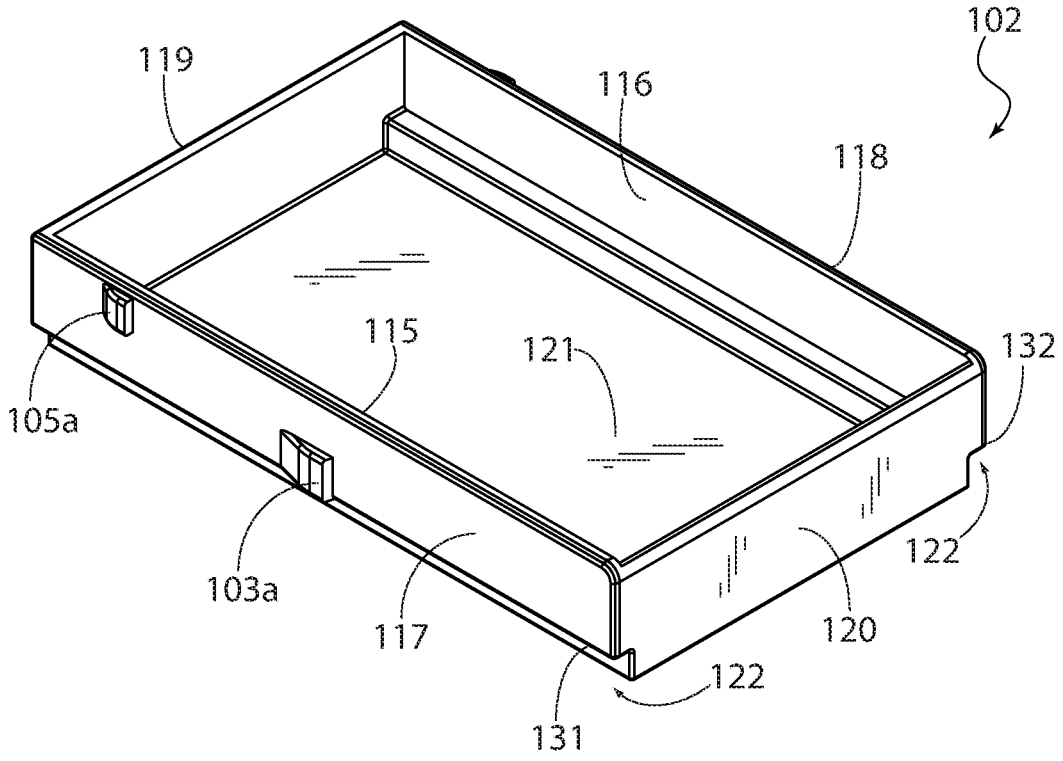
FIG. 5(*a*) illustrates a perspective view of a base shell for a childproof box in accordance with an exemplary embodiment of the present invention.
Figure 5B:
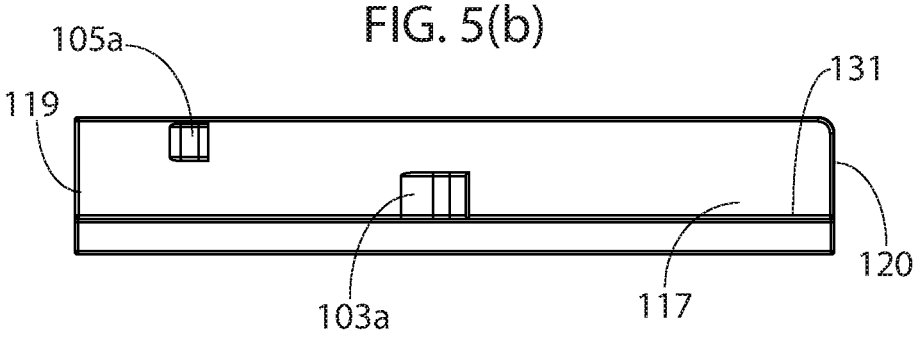
Figure 5C:
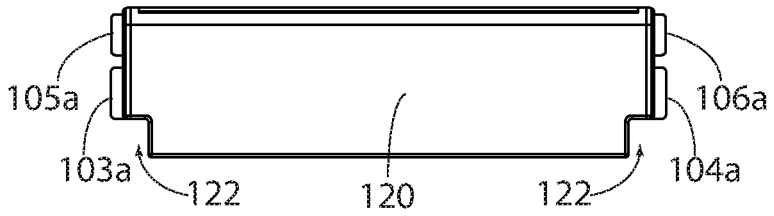
Figure 5D:
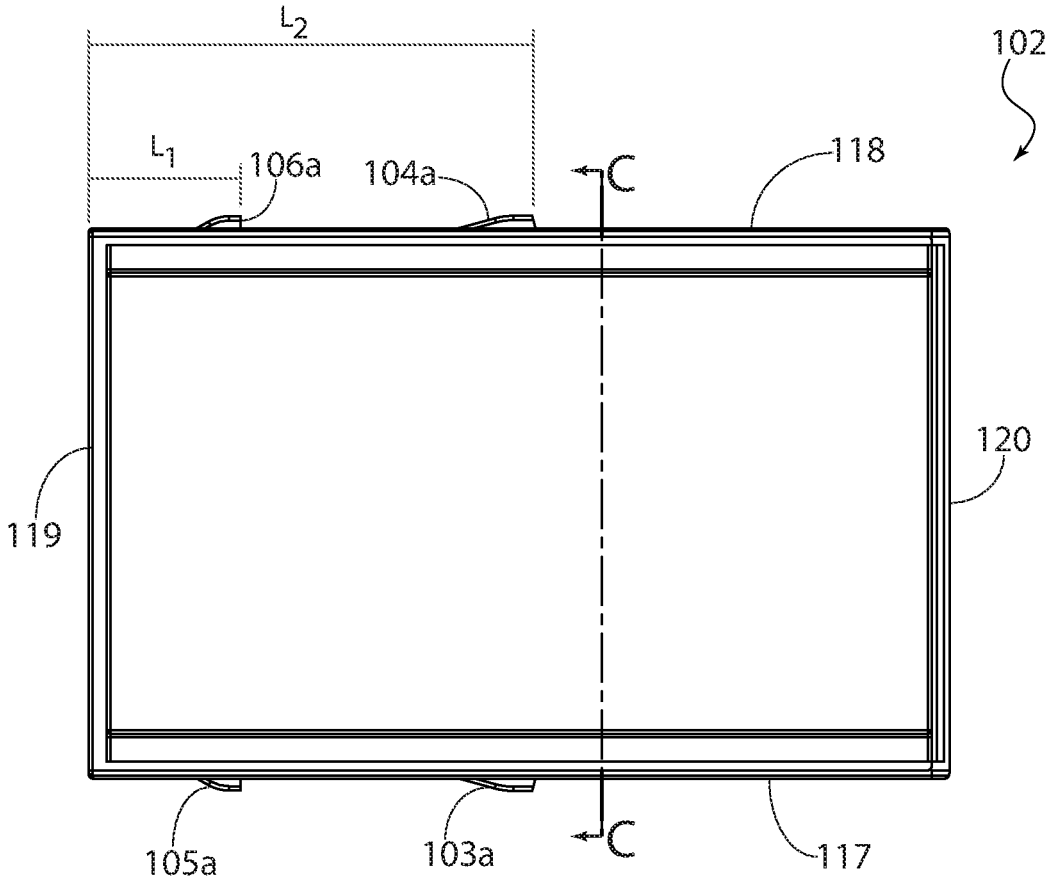
Figure 5E:
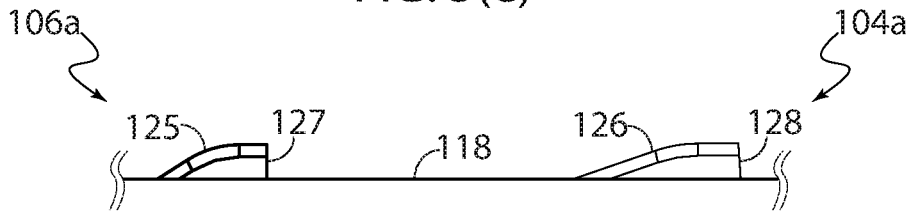
Figure 5F:
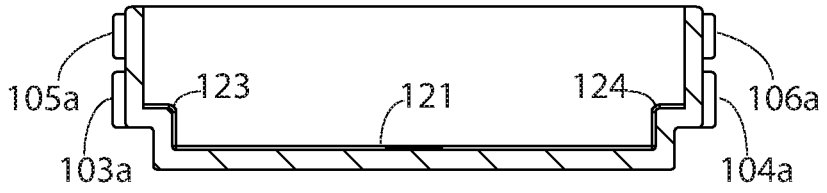

Turning next to FIG. 3, a perspective exploded view of childproof box 100 is illustrated. The exploded view better depicts each of the locking ridges 103*a*, 104*a*, 103*b*, and 104*b* protruding from side walls on their respective shells are visible. Similarly, this view better depicts each of the retention ridges 105*a*, 106*a*, 105*b*, and 106*b* protruding from side walls of their respective shells. It may also be noticed that each of retention ridges 105*a*, 106*a*, 105*b*, and 106*b* on their respective shells are situated along side walls at a height that is greater than a height of each of the locking ridges 103*a*, 104*a*, 103*b*, and 104*b*. Further, the ridges (locking and retention ridges) of flexible cover shell 101 are situated along interior side walls of flexible cover shell 101 protruding towards the interior cavity, while the ridges (locking and retention ridges) of rigid base shell 102 are situated along exterior or exterior side walls of rigid base shell 102, protruding towards the interior side walls of flexible cover shell 101.

Turning now to the next set of figures, FIG. 4(*a*) illustrates a perspective view of flexible cover shell 101 of childproof box 100 in accordance with an exemplary embodiment of the present invention. More specifically, FIG. 4(*a*) depicts flexible cover shell 101, comprising top surface 111, front opening 110, a cover back wall (back wall 109; (see also FIG. 4(*c*)-(*f*))), and two cover side walls (side walls 107 and 108), which form an open cavity in-between that extends inward from front opening 110 towards back wall 109. Side walls 107 and 108 include tracks 113 and 114, which run a length along a bottom edge of an interior side surface of each cover side wall 107 and 108. Further, flexible cover shell 101 also comprises serrated section 112, which provides a user with friction to facilitate the pressing and sliding motion required to slide open rigid base shell 102 away from flexible cover shell 101 so as to access the storage cavity therein.

FIG. 4(*b*) illustrates a front view of flexible cover shell 101. From this view, without rigid base shell 102, locking ridges 103*b* and 104*b* as well as retention ridges 105*b* and 106*b* may be seen protruding from the interior or interior side surface (of side walls 107 and 108) of cover shell 101. As may be appreciated from this view, the pair of retention ridges 105*b* and 106*b* of flexible cover shell 101 are situated along the interior side surface closer to an interior top surface 111*a* and above the pair of locking ridges 103*b* and 104*b* of flexible cover shell 101, so that retention ridges 105*b* and 106*b* are situated at a greater height (along a length of each side wall 107 and 108, respectively) than the height of locking ridges 103*b* and 104*b*. Moreover, the pair of locking ridges 103*b* and 104*b* are situated in proximity, or immediately adjacent to, tracks 113 and 114, respectively. Further, each of locking ridges 103*b* and 104*b* may have a height that is approximately less than half the height of the inner side surface of the corresponding side wall. Similarly, each of retention ridges 105*b* and 106*b* may have a height that is also approximately less than half the height of the inner side surface of the corresponding side wall. In exemplary embodiments, retention ridges 105*b* and 106*b* are smaller than (or have a height less than) a height of locking ridges 103*b* and 104*b*.

FIG. 4(*c*) illustrates a back view of flexible cover shell 101, showing back wall 109 is generally flat and smooth without any protrusions or curvature, similar to side walls 107 and 108 as illustrated in the side view of FIG. 4(*d*). Similarly, top surface 111 is generally smooth (with the exception of serrated section 112), runs substantially parallel to bottom surface 121 of rigid base shell 102, and does not include a curvature other than (in exemplary embodiments) smoothed edges of corners 155 of flexible cover shell 101. In exemplary embodiments, the smooth edges and flat surfaces of flexible cover shell 101 make the device easy to hold and operate. Moreover, the flat smooth surfaces make the device easy to store in a pocket, and easy for a distributer, such as a shop, pharmacy, or supplier, to store in large inventory form.

FIG. 4(*e*) illustrates a top view of flexible cover shell 101. Other than serrated section 112, top surface 111 is generally smooth and planar or flat. In exemplary embodiments, serrated section 112 may have printed instructions such that a user may read how to operate childproof box 100. Of course, in other embodiments serrated section 112 may not be implemented at all, without deviating from the scope of the present invention.

FIG. 4(*f*) illustrates a bottom view of flexible cover shell 101, where it may be appreciated that the cover shell includes an interior top surface 111*a* (see also FIG. 4(*b*)) having a planar or flat surface excluding any protrusions or structures that may otherwise interfere with items or articles that may be stored using childproof box 100. Moreover, from the bottom view of the flexible cover shell, it may be appreciated that back wall 109 has an interior back surface 109*a*, which is also smooth and does not include any structures or protrusions that may interfere with or otherwise minimize the size of the cavity within flexible cover shell 101 (and thereby minimizing storage within childproof box 100). Further, tracks 113 and 114 may be seen extending from the front opening 110 and terminating at recesses 113*a* and 114*a* (respectively). This configuration of the underside of the cover shell forms or defines an aperture 119*a* formed between interior back surface 109*a* of back wall 109 and each of the tracks 113 and 114. As mentioned above, aperture 119*a* adds additional flexibility to flexible cover shell 101.

FIG. 4(*g*) illustrates a cross-sectional view of flexible cover shell 101 taken along cross-sectional line B (in the direction of the arrows or towards interior back surface 109*a* of back wall 109). More specifically, from this view, it may be appreciated that the pair of retention ridges 105*b* and 106*b* or locking ridges 103*b* and 104*b* protruding from the interior side surface of the flexible cover shell 101 are not visible so that the visible portions of interior walls of side walls 107 and 108 are smooth—in contrast with the front view of FIG. 4(*b*), or the cross-sectional view along line A (see FIG. 1) that will be discussed further below with reference to FIG. 6(*a*), FIG. 6(*b*), and FIG. 7. This is because the pair of retention ridges 105*b* and 106*b* are situated in proximity to the front opening 110 of flexible cover shell 101, and the pair of locking ridges 103*b* and 104*b* are situated substantially at the center or middle portion of the cover shell and slightly closer to opening 110 (to the right of cross-sectional line B) than to interior back wall 109*a*. Also from this view, the proportions of tracks 113 and 114 may be further appreciated, which are generally of a thickness enough to structurally grasp or register with rigid base shell 102 but not so thick that they interfere with a flexibility of flexible cover shell 101. As in the shown embodiment, tracks 113 and 114 are configured to support the side walls (117 and 118) of rigid base shell 102 in a manner such that a bottom portion (or corresponding tracks 122) of each of the base's side walls 117 and 118 rest along a length of each track 113 and 114, respectively.

Turning now to the next set of figures, FIG. 5(*a*) illustrates a perspective view of a rigid base shell for childproof box 100 in accordance with an exemplary embodiment of the present invention. More specifically, FIG. 5(*a*) depicts rigid base shell 102, which in the shown exemplary embodiment comprises bottom surface 121, front wall 120, base back wall (back wall 119) and two base side walls (side walls 118 and 117), forming a closed cavity in-between. Each of side walls 117 and 118 have interior surfaces 115 and 116 respectively, and include corresponding tracks 122 formed by step ridges 123 and 124 (see FIG. 5(*f*)) that run along an entirety of a length of rigid base shell 102 between front wall 120 and back wall 119. Corresponding tracks 122 are configured to register with tracks 113 and 114 of flexible cover shell 101. As may be appreciated from this view, every interior wall or interior surface of front wall 120 and back wall 119 as well as bottom surface 121, side walls 117 and 118 (or their interior surfaces 115 and 116) are substantially smooth, free of any structures or mechanisms that may interfere with the space or cavity within rigid base shell 102 so that storage space is maximized.

On each outer or exterior surface of side walls 117 and 118, locking ridges 103*a* and 104*a* that correspond to the locking ridges 103*b* and 104*b* of flexible cover shell 101 and retention ridges 105*a* and 106*a* that correspond to the retention ridges 105*b* and 106*b* of flexible cover shell 101 extend outwardly or protrude from the exterior surface.

FIG. 5(*b*) illustrates a side view of rigid base shell 102, in accordance with an exemplary embodiment of the present invention. From this view, it may be appreciated that corresponding tracks 122 extend along a bottom edge of each side wall 117 and 118 from front wall 120 to back wall 119 of the rigid base shell 102. From this view, as well as from the view depicted by FIG. 5(*a*), it may be appreciated that the pair of corresponding retention ridges 105*a* and 106*a* protruding from the exterior side surface of the base side walls 117 and 118 of the rigid base shell 102 are situated in relative proximity to the base back wall 119. Moreover, from the side view of FIG. 5(*b*) as well as the front view of FIG. 5(*c*), it is noticeable that the pair of corresponding retention ridges 105*a* and 106*a* of the rigid base shell 102 are situated at a greater height along the exterior side surface than a height of the pair of corresponding locking ridges 103*a* and 104*a* of the rigid base shell 102. Furthermore, the pair of corresponding locking ridges 103*a* and 104*a* protrude from the exterior side surface of the base side walls 117 and 118 of the rigid base shell 102 along an edge (131 and 132, respectively) of the corresponding tracks 122.

FIG. 5(*d*) illustrates a top view of rigid base shell 102 in accordance with an exemplary embodiment of the present invention. More specifically, FIG. 5(*d*) depicts exemplary configurations of locking ridges 104*a* and 103*a* and retention ridges 105*a* and 106*a*. In such exemplary embodiment, corresponding retention ridges 105*a* and 106*a* protrude from side walls 117 and 118 a length $L_1$ from back wall 119 of rigid base shell 102. In such exemplary embodiment, corresponding locking ridges 103*a* and 104*a* protrude from side walls 117 and 118 a length $L_2$ from back wall 119 of rigid base shell 102. Accordingly, each pair of corresponding retention ridges protruding from the exterior side surface of the base side walls of the rigid base shell are situated in proximity to the base back wall in relation to the corresponding locking ridges. Further still, from this view, it may be appreciated that the bottom surface 121 of the rigid base shell 102 is a flat surface excluding any protrusions.

FIG. 5(*e*) illustrates a close-up view of retention protrusion 106*a* and locking protrusion 104*a*, in accordance with an exemplary embodiment of the present invention. From this view, it may be appreciated that the corresponding locking ridges 104*a* and 103*a* may have a greater length than a length of the corresponding retention ridges 105*a* and 106*a* and typically include gradual edges 125 and 126 respectively in order to facilitate entry into the cavity of flexible cover shell 101. Further, these components further include substantially perpendicular edges 127 and 128 which engage with corresponding components of the flexible cover shell (also substantially perpendicular) in order to retain or lock each shell in place. Although not shown in this figure, locking ridges have a greater length than a length of the retention ridges of flexible cover shell 101 and are generally similar to each other in construction in that they each protrude from a side wall of their respective shells. FIG. 5(*f*) illustrates a cross-sectional view of rigid base shell 102 taken along cross-sectional line C (in the direction of the arrows or towards back wall 119).

Figure 6A:
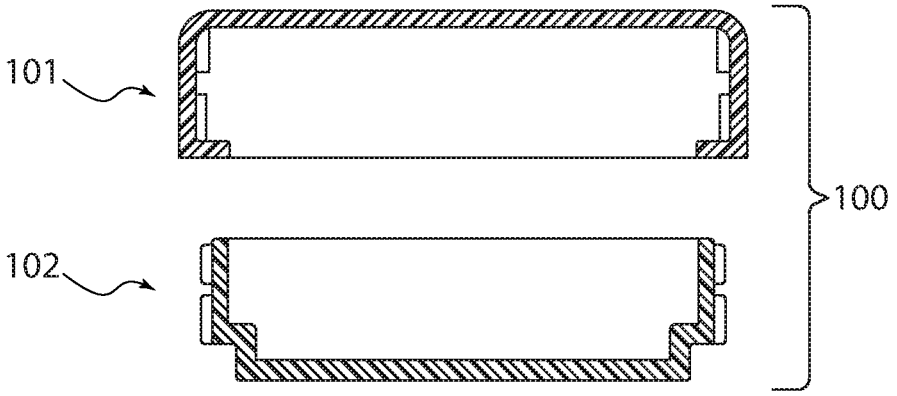
FIG. 6(*a*) illustrates a cross-sectional exploded view of a childproof box in accordance with an exemplary embodiment of the present invention.
Figure 6B:
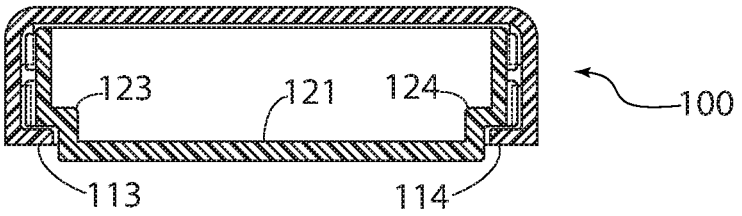

Turning now to the next set of figures, FIG. 6(*a*) illustrates a cross-sectional exploded view of childproof box 100, taken along the line A (as shown in FIG. 1) in accordance with an exemplary embodiment of the present invention; similarly, FIG. 6(*b*) illustrates a cross-sectional view of childproof box 100. From this view, it may be appreciated that in an exemplary embodiment, a bottom exterior surface of the rigid base shell may sit slightly below the tracks of the flexible cover shell.

Figure 7:
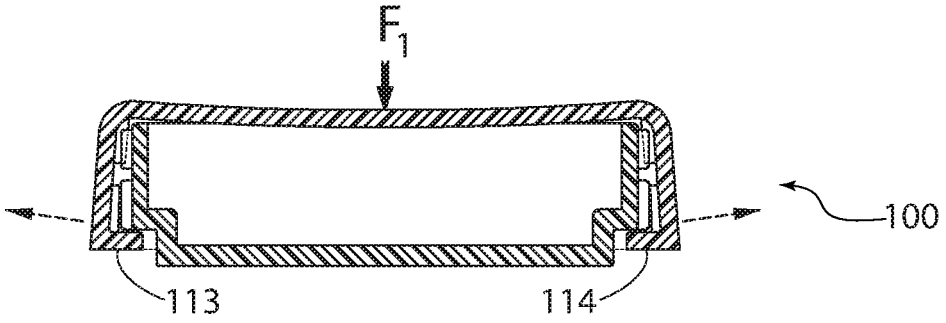
FIG. 7 illustrates a cross-sectional view of a childproof box in accordance with an exemplary embodiment of the present invention, depicting movement of structural elements during its operation.

Finally turning to the last figure, FIG. 7 illustrates a cross-sectional view of childproof box 100 in accordance with an exemplary embodiment of the present invention, depicting a method of operation. More specifically, from this view it may be appreciated that pressing down and pushing on the top surface 111 of flexible cover 101 disengages each locking component 103 and 104 without misaligning retention components 105 and 106, which remain engaged. That is the pair of retention ridges 105*b* and 106*b* of the flexible cover shell 101 stay engaged with the pair of corresponding retention ridges 105*a* and 106*a* of the rigid base shell 102, thereby retaining the rigid base partially within the open cavity of the flexible cover, when it is opened. Since pressing down and pushing on the top surface 111 of flexible cover 101 does not misalign retention ridges 105*b* and 106*b* from retention ridges 105*a* and 106*a*, retention components 105 and 106 prevent the rigid base shell 102 from being removed completely or disengaged from flexible cover shell 101.

This may be achieved because cover 101 is constructed so that it is flexible and can bend sufficiently in order for the side walls to swing outwardly. However, they do not swing so outwardly as to misalign retention components 105 and 106. Similarly, base 102 is constructed so that it is rigid, which keeps corresponding locking ridges 103*a* and 104*a* as well as corresponding retention ridges 105*a* and 106*a* substantially still—movement preferably only occurs at the side walls of the flexible cover.

In exemplary practice, operating the present invention may be achieved with a single hand. For example, and without limiting the scope of the present invention, supposing a user holds childproof box 100 in their right hand, the user may support childproof box 100 between their right index finger and their right thumb of their right hand, their thumb placed over a center portion of childproof box 100—for example over serrated section 112 of top surface 111 of childproof box 100. Using their right thumb, the user may press down as shown by direction $F_1$ and push or slide their thumb in a forward direction along (for example) direction $F_2$ shown in FIG. 2. In this manner, an adult user may easily operate childproof box 100 with a single hand.

A childproof box has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

What is claimed is:

1. A childproof box, comprising:

a flexible cover shell, including two cover side walls comprising a pair of locking ridges and a pair of retention ridges protruding from an interior side surface of each cover side wall; and a rigid base shell that slidably registers inside an open cavity of the flexible cover shell, the rigid base shell including two base side walls comprising a pair of corresponding locking ridges and a pair of corresponding retention ridges protruding from an exterior side surface of each base side wall;

wherein:

pressing and pushing on a top surface of the flexible cover shell disengages the pair of locking ridges from the pair of corresponding locking ridges without misaligning the pair of retention ridges from the pair of corresponding retention ridges.

2. The childproof box of claim 1, wherein the flexible cover shell further includes tracks running along a bottom edge of the interior side surface of each cover side wall.

3. The childproof box of claim 2, wherein the rigid base shell further includes corresponding tracks configured to register with the tracks of the flexible cover shell.

4. The childproof box of claim 3, wherein the pair of corresponding locking ridges are situated along an edge of the corresponding tracks.

5. The childproof box of claim 2, wherein the pair of locking ridges are situated in proximity to the tracks.

6. The childproof box of claim 1, wherein the pair of retention ridges are situated in proximity to a front opening of the flexible cover shell.

7. The childproof box of claim 1, wherein the pair of corresponding retention ridges are situated in proximity to a base back wall of the rigid base shell.

8. The childproof box of claim 1, wherein the pair of retention ridges are situated at a greater height along the interior side surface of the flexible cover shell than a height of the pair of locking ridges along the interior side surface of the flexible cover shell.

9. The childproof box of claim 1, wherein the pair of corresponding retention ridges are situated at a greater height along the exterior side surface of the rigid base shell than a height of the pair of corresponding locking ridges along the exterior side surface of the rigid base shell.

10. The childproof box of claim 1, wherein each of the pair of locking ridges comprises a height that is approximately less than half a height of the inner side surface.

11. The childproof box of claim 1, wherein each of the pair of retention ridges comprises a height that is approximately less than half a height of the inner side surface.

12. The childproof box of claim 1, wherein each of the pair of retention ridges is smaller than each of the pair of locking ridges.

13. The childproof box of claim 1, wherein the flexible cover shell and the rigid base shell are rectangular.

14. The childproof box of claim 1, wherein an exterior surface of the flexible cover shell includes a serrated area.

15. The childproof box of claim 1, wherein the flexible cover shell and rigid base shell are constructed using a plastic resin certified as USP Class VI.

16. The childproof box of claim 1, wherein the rigid base shell comprises a bottom exterior surface that sits below the tracks of the flexible cover shell.

17. The childproof box of claim 1, wherein the top surface of the flexible cover shell further includes smooth corners.

18. The childproof box of claim 1, wherein the flexible cover shell further includes an aperture formed between an interior back surface of a back wall of the flexible cover shells and each of a pair of tracks running along a bottom edge of the interior side surface of each cover side wall.

19. The childproof box of claim 1, wherein each of the pair of locking ridges, corresponding locking ridges, retention ridges and corresponding retention ridges comprise:

a gradual edge to facilitate entry of the rigid base shell into the cavity of flexible cover shell, and a substantially perpendicular edge to lock the rigid base shell inside the flexible cover shell.

20. The childproof box of claim 1, wherein the pair of locking ridges protruding from the interior side surface of each cover side wall do not align horizontally with the pair of retention ridges protruding from the interior side surface of each cover side wall.

* * * * *